US009214729B2

(12) United States Patent
Chen et al.

(10) Patent No.: US 9,214,729 B2
(45) Date of Patent: Dec. 15, 2015

(54) ANTENNA AND ARRAY ANTENNA

(71) Applicant: Wistron NeWeb Corporation, Hsinchu (TW)

(72) Inventors: I-Shan Chen, Hsinchu (TW); Guo-Shu Huang, Hsinchu (TW); Cheng-Hsiung Hsu, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 295 days.

(21) Appl. No.: 13/802,391

(22) Filed: Mar. 13, 2013

(65) Prior Publication Data

US 2014/0145909 A1 May 29, 2014

(30) Foreign Application Priority Data

Nov. 28, 2012 (TW) ..... 101144453 A

(51) Int. Cl.

| | |
|---|---|
| ***H01Q 21/06*** | (2006.01) |
| ***H01Q 9/04*** | (2006.01) |
| ***H01Q 21/08*** | (2006.01) |
| ***H01Q 9/40*** | (2006.01) |

(52) U.S. Cl.

CPC ..... *H01Q 9/0407* (2013.01); *H01Q 9/40* (2013.01); *H01Q 21/065* (2013.01); *H01Q 21/08* (2013.01)

(58) Field of Classification Search

CPC ..... H01Q 9/0407; H01Q 21/065; H01Q 9/04; H01Q 21/0006; H01Q 21/0025; H01Q 21/0075; H01Q 21/06; H01Q 21/061; H01Q 7/00

See application file for complete search history.

(56) References Cited

U.S. PATENT DOCUMENTS 4,180,817 A * 12/1979 Sanford ..... 343/700 MS
6,121,930 A * 9/2000 Grangeat et al. ..... 343/700 MS

OTHER PUBLICATIONS

Kin-Lu Wong, "Compact and Broadband Microstrip Antennas", 2002 by John Wiley & Sons, Inc., New York, cover letter and p. 92-111, 261-267.

You-Chien Chen and Powen Hsu, "CPW-fed folded slot dipole antenna for mobile handset applications", 2011 IEEE International Symposium on Antennas and Propagation, p. 1932-1935, Jul. 3-8, 2011.

* cited by examiner

*Primary Examiner* — Robert Karacsony
*Assistant Examiner* — Patrick Holecek
(74) *Attorney, Agent, or Firm* — Winston Hsu; Scott Margo

(57) ABSTRACT

An antenna includes a radiating element with a shape substantially conforming to a quadrilateral, a grounding and feed-in element, substantially surrounding the radiating element and having an opening formed near to a fourth side of the radiating element, wherein the grounding and feed-in element is electrically connected to a ground at one side of the opening and is electrically connected to a signal feed-in terminal at another side of the opening, a first connection element, having a terminal electrically connected to a first side and the fourth side of the radiating element, and another terminal electrically connected to the grounding and feed-in element, and a second connection element, having a terminal electrically connected to a third side and the fourth side of the radiating element, and another terminal electrically connected to the grounding and feed-in element.

20 Claims, 11 Drawing Sheets

ANTENNA AND ARRAY ANTENNA

BACKGROUND OF THE INVENTION

1. Field of the Invention

The present invention relates to an antenna and an array antenna, and more particularly, to an antenna and an array antenna capable of effectively increasing a gain of the array antenna, reducing an antenna area, and optimizing an antenna radiation pattern.

2. Description of the Prior Art

An array antenna is an antenna system composed of a plurality of identical antennas regularly arranged, and is widely used in a radar system. For space-limited applications such as automotive radar systems, designs for the array antennas are much more complicated.

In detail, an automotive radar system utilizes wireless signal transceivers disposed inside vehicle bumpers or grills to transmit or receive millimeter-wave wireless signals for ranging and information exchange applications. Since shock-absorbing Styrofoam or glass fibers are usually disposed inside the vehicle bumpers, the available space is limited. Therefore, the radar signal attenuates easily, which increases difficulty of the array antenna designs. In addition, if the automotive radar system is produced for sales of after-market, i.e. vendors for the radar systems do not participate in decision-making of materials and thickness of the bumpers, in such a condition, design requirements for the array antenna gain, the area and the radiation patterns become stricter for adapting to different cars.

In general, most automotive radar vendors utilize microstrip array antennas with coupling structures to minimize the required area. However, the operating frequency bands of the automotive radar systems are close to 24 GHz and 77 GHz. At such high frequencies, it is difficult to improve the antenna efficiency and thereby increase the antenna gain, especially with the coupling structures, since the coupling structures merely broaden the antenna bandwidth, but may affect the original beam, and cause deviation if the antenna patterns have frequency offsets. As a result, sensitivity of the transceiver in the radar system is affected, and the radar algorithm also needs to be modified in order to maintain normal radar detection.

Therefore, it is a common goal in the industry to effectively increase the array antenna gain, reduce the antenna area and optimize the antenna radiation patterns.

SUMMARY OF THE INVENTION

Therefore, the present invention mainly provides an antenna and an array antenna, which can effectively increase the array antenna gain, reduce the antenna area, and optimize the antenna radiation patterns.

The present invention discloses an antenna, comprising a radiating element, with a shape substantially conforming to a quadrilateral, having a first side, a second side, a third side and a fourth side, wherein the first side and the third side are substantially parallel, the second side and the fourth side are substantially parallel, and the first side is substantially perpendicular to the second side; a grounding element, substantially surrounding the radiating element, and having an opening formed near the fourth side of the radiating element, wherein the grounding element is electrically connected to a ground at one side of the opening and is electrically connected to a signal feed-in terminal at another side of the opening; an extending bar, electrically connected to the fourth side of the radiating element, and extended toward the opening of the grounding element; a first connection element, having a terminal electrically connected to the first side and the fourth side of the radiating element, and another terminal electrically connected to the grounding element; and a second connection element, having a terminal electrically connected to the third side and the fourth side of the radiating element, and another terminal electrically connected to the grounding element.

The present invention further discloses an array antenna, comprising a plurality of radiating elements, each with a shape substantially conforming to a quadrilateral, having a first side, a second side, a third side and a fourth side, wherein the first side and the third side are substantially parallel, the second side and the fourth side are substantially parallel, and the first side is substantially perpendicular to the second side; a plurality of extending bars, each electrically connected to a fourth side of a radiating element and a second side of another radiating element among the plurality of radiating elements such that the plurality of radiating elements are concatenated in a series; a grounding element, substantially surrounding the plurality of radiating elements, and having an opening formed near a fourth side of a radiating element among the plurality of radiating elements, wherein the grounding element is electrically connected to a ground at one side of the opening and is electrically connected to a signal feed-in terminal at another side of the opening; a plurality of first connection elements, each having a terminal electrically connected to a first side and a fourth side of a radiating element among the plurality of radiating elements, and another terminal electrically connected to the grounding element; and a plurality of second connection elements, each having a terminal electrically connected to a third side and a fourth side of a radiating element among the plurality of radiating elements, and another terminal electrically connected to the grounding element.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
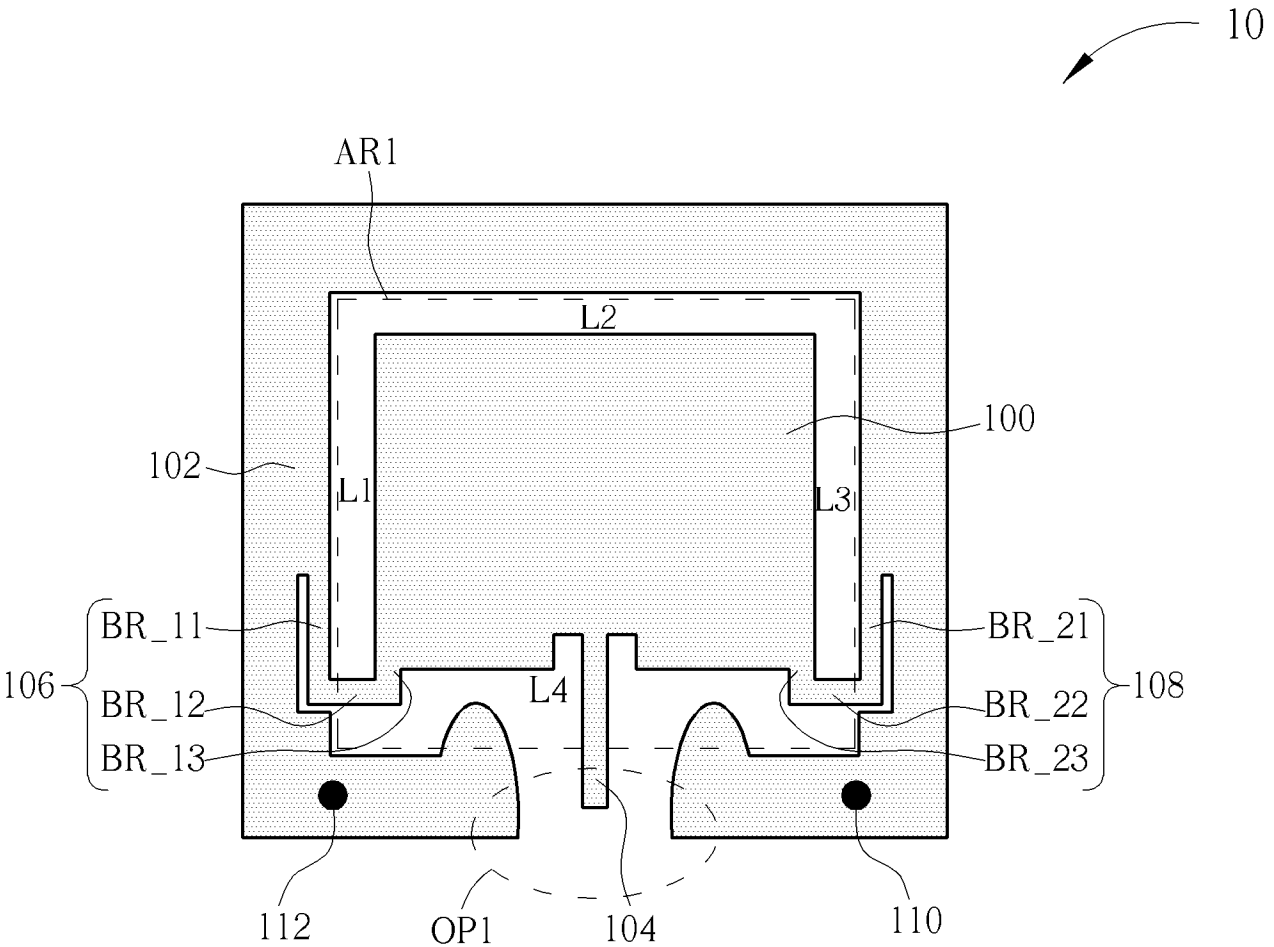
FIG. 1 is a schematic diagram of an antenna according to an embodiment of the present invention.

Please refer to FIG. 1, which is a schematic diagram of an antenna 10 according to an embodiment of the present invention. The antenna 10 is used for transmitting and receiving wireless signals, and is especially suitable for space-limited applications, such as automotive radar systems. The antenna 10 includes a radiating element 100, a grounding element 102, an extending bar 104, a first connection element 106 and a second connection element 108. The radiating element 100 has a shape substantially conforming to a quadrilateral with a first to fourth sides denoted by L1-L4 as shown FIG. 1. The grounding element 102 substantially surrounds the radiating element 100 by forming an area AR1 in which the radiating element 100 is disposed, and the grounding element 102 has an opening OP1 formed near the fourth side L4. The grounding element 102 is electrically connected to a ground at one of the locations near the opening OP1, for example, points 110 and 112 shown in FIG. 1. In other words, the point 110 is electrically connected to the ground, or the point 112 is electrically connected to the ground. One end of the extending bar 104 is electrically connected to a signal feed-in terminal, and the other end of the extending bar 104 is extended toward the opening OP1 of the grounding element 102 at the fourth side L4 of the radiating element 100. The first connection element 106, composed of branches BR_11-BR_13, has a terminal electrically connected to the first side L1 and the fourth side L4 of the radiating element 100 and another terminal electrically connected to the grounding element 102. The second connection element 108, composed of branches BR_21-BR_23, has a terminal electrically connected to the third side L3 and the fourth side L4 of the radiating element 100, and another terminal electrically connected to the grounding element 102. Besides, as can be seen in FIG. 1, open slots are formed between the first connection element 106 and the grounding element 102, and between the second connection element 108 and the grounding element 102, respectively. Widths of the open slots can be used for adjusting bandwidth characteristics of antenna resistance of the antenna 10.

In detail, the first connection element 106 and the second connection element 108 are symmetrical with regard to a centerline of the radiating element 100 (or the extending bar 104), and both used for connecting the radiating element 100 and the grounding element 102. Besides, lengths of the first connection element 106 and the second connection element 108 are preferably equal to a quarter-wavelength of a wireless signal to be transmitted or received. In other words, the connecting portion between the first connection element 106 and the grounding element 102 forms a short circuit, and the connecting portion between the first connection element 106 and the radiating element 100 is equivalent to an open circuit. Similarly, the connecting portion between the second connection element 108 and the grounding element 102 forms a short circuit, and the connecting portion between the second connection element 108 and the radiating element 100 is equivalent to an open circuit. In such a condition, utilizing the first connection element 106 and the second connection element 108, a length of the radiating element 100 in a vertical direction (i.e. the length of the first side L1 or the third side L3) is reduced to a value between 0.3 and 0.45 wavelengths, which is obviously smaller than a 0.5 wavelength of the conventional structures.

Figure 2:
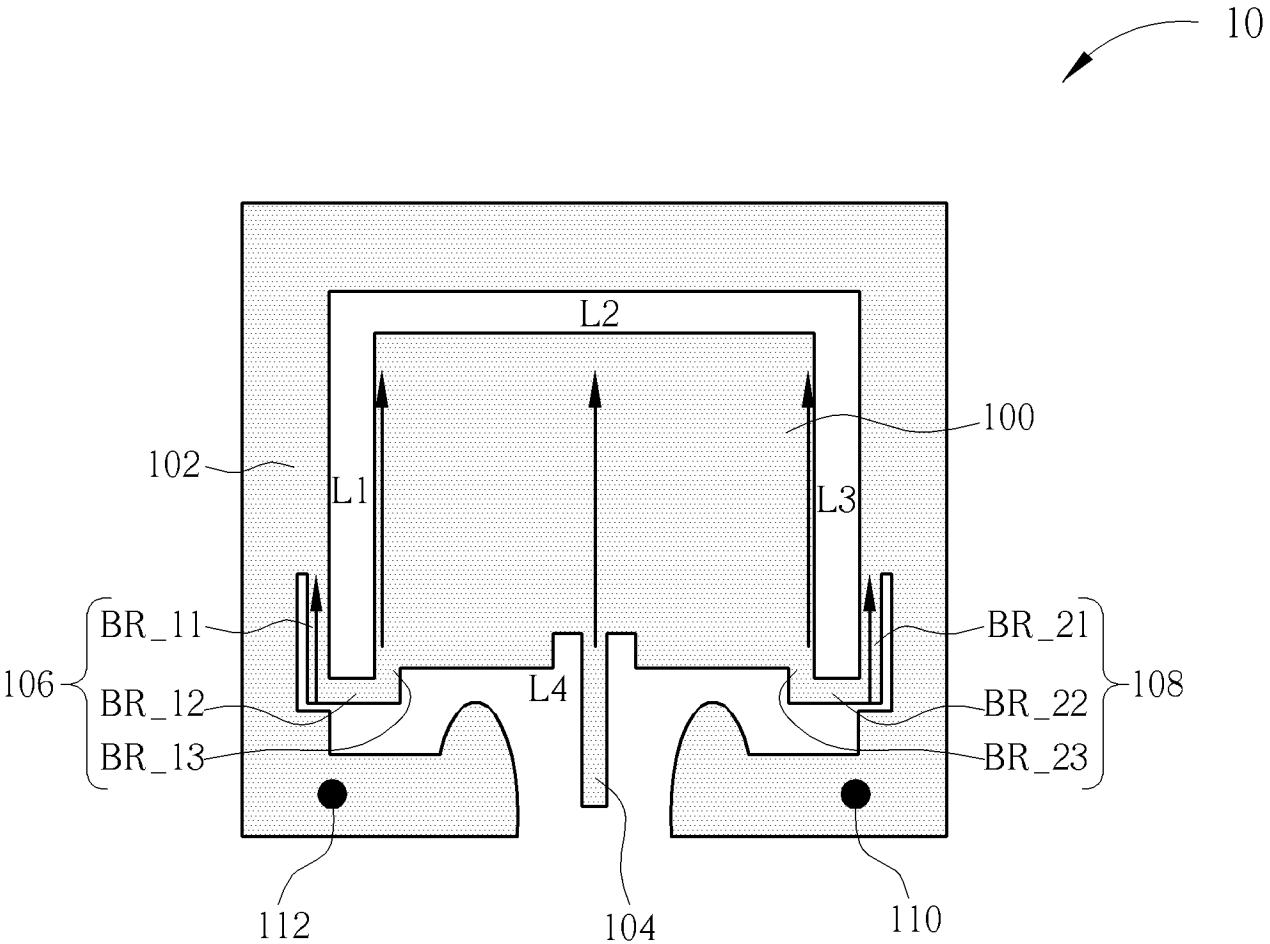
FIG. 2 is a schematic diagram of current directions of the antenna in FIG. 1.

Please continue referring to FIG. 2, which is a schematic diagram of current directions of the antenna 10. As shown in FIG. 2, the branch BR_11 of the first connection element 106 and the branch BR_21 of the second connection element 108 are both parallel with the current direction on the radiating element 100, and the connecting portions between the first connection element 106 and the radiating element 100 and between the second connection element 108 and the radiating element 100 are equivalent to open circuits, such that additional currents are induced on the branches BR_11, BR_21, which constructively enhances currents on the radiating element 100, as well as the antenna radiation efficiency and the antenna gain. Besides, since the first connection element 106 and the second connection element 108 are symmetrical in the horizontal direction, the horizontal currents, i.e. the currents on the branches BR_12, BR_22, cancel out with each other. Thus, no additional radiation patterns are generated, and the currents are gathered at the center and two sides, which maintains the antenna patterns and increases the antenna efficiency. On the other hand, since the branches BR_11, BR_21 provide additional current paths, distances between the branches BR_11, BR_21 and the grounding element 102 may affect a coupling effect, or inductance or capacitance characteristics between the radiating element 100 and the grounding element 102. In other words, by adjusting the distances between the branches BR_11, BR_21 and the grounding element 102, characteristics of the antenna 10 may be adjusted accordingly, and hence more design flexibility is provided.

Figure 3:
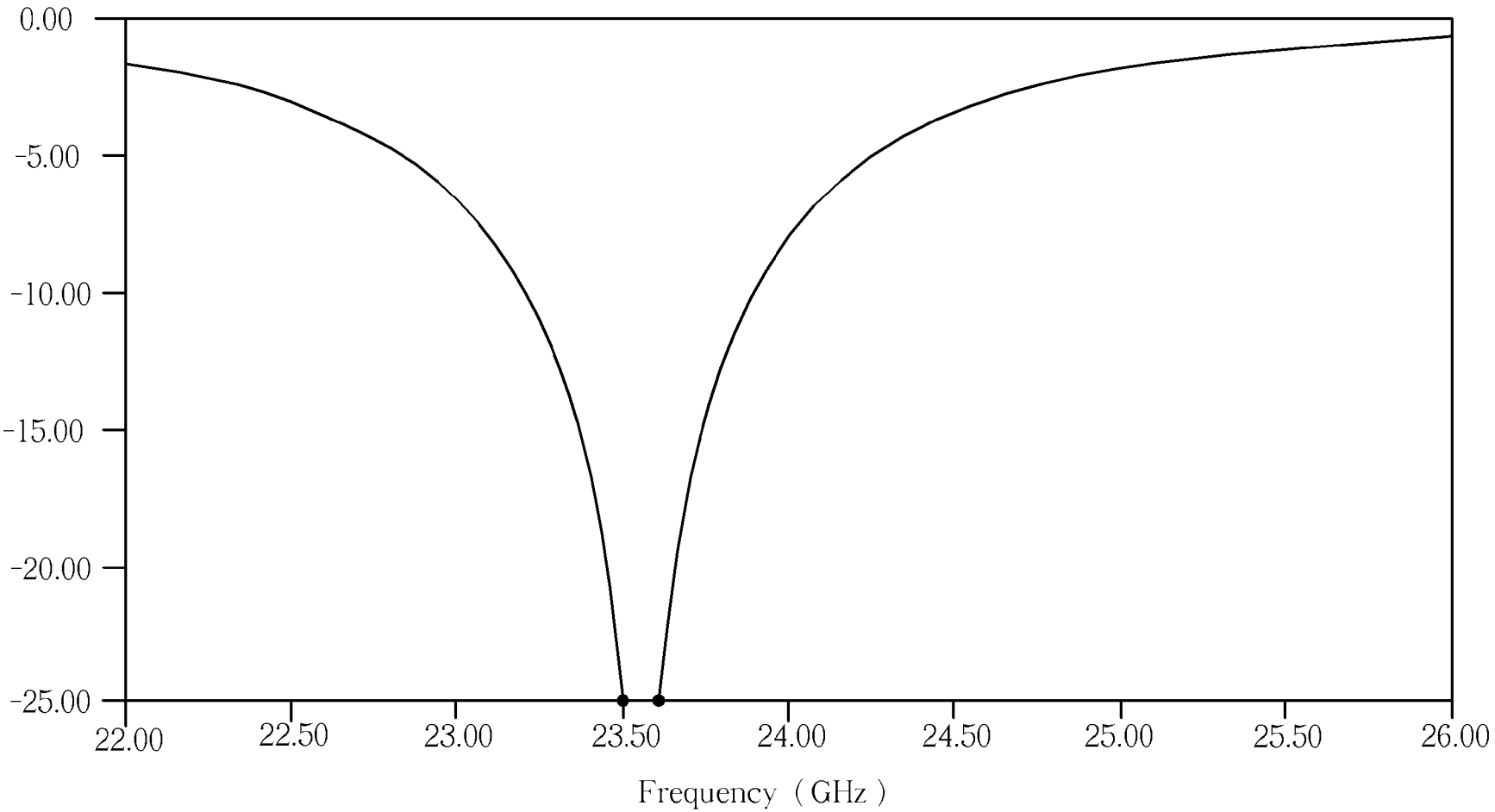
FIG. 3 is a diagram of voltage standing wave ratio (VSWR) of the antenna in FIG. 1.
Figure 4:
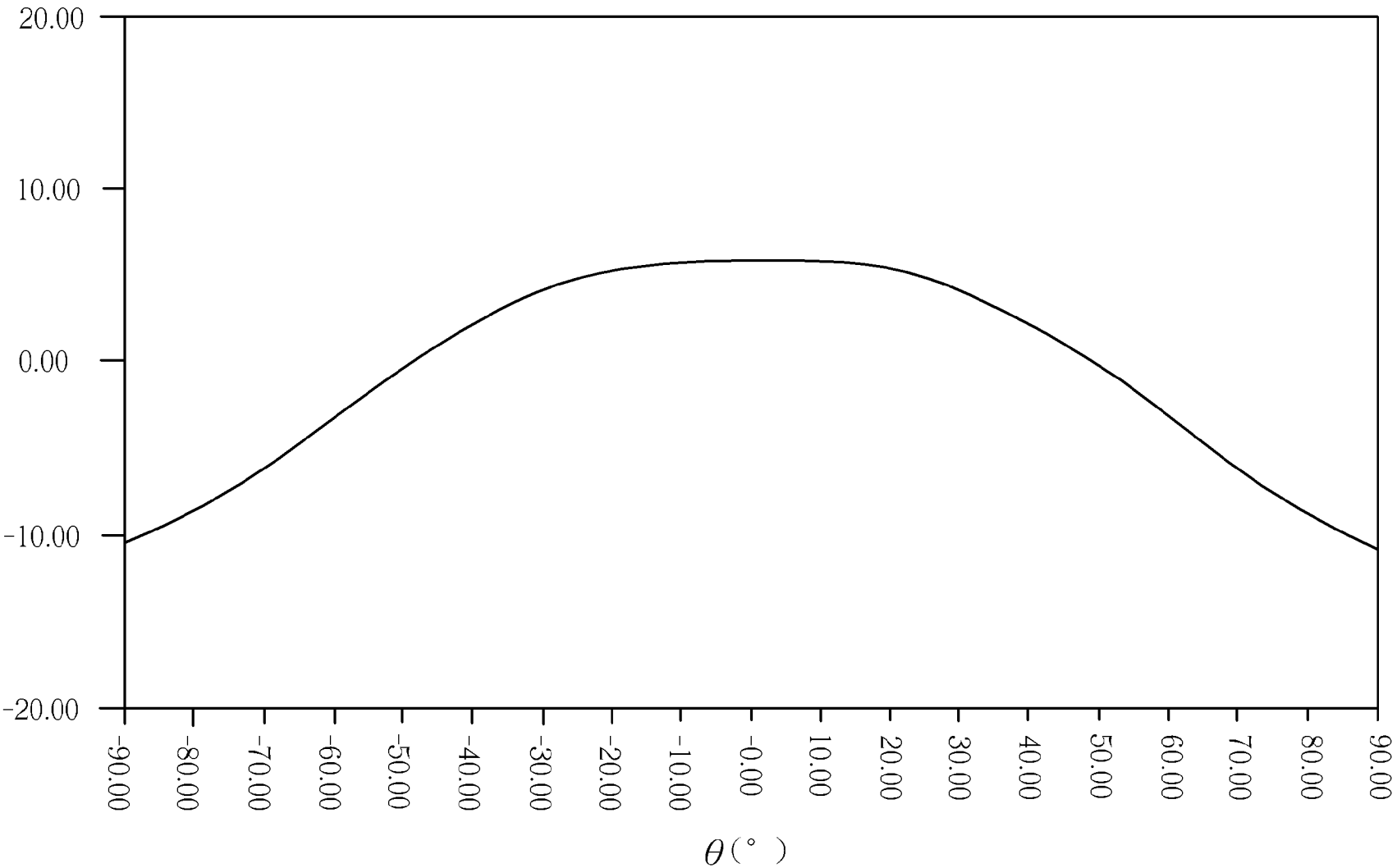
FIG. 4 is a diagram of azimuth antenna patterns of the antenna in FIG. 1.

Note that, the antenna 10 shown in FIG. 1 is an embodiment of the present invention, and those skilled in the art can make modifications and alterations accordingly. For example, the antenna 10 may be made of metal, or a conductive coating material formed on a surface of a product housing by performing coating, printing, evaporation deposition, or laser direct structuring (LDS) with isolating paint or glue covered. Besides, in FIG. 1, the connecting portion between the fourth side L4 and the extending bar 104 forms a concavity (or gap), which is required by different applications, and is not limited thereto. Similarly, the grounding element 102 has two bulges near the opening, which can be adjusted according to system requirements. The first connection element 106 is composed of the branches BR_11-BR_13 each perpendicular to a neighboring branch, which is one of possible embodiments. The first connection element 106 may be composed of branches of different forms or numbers, and the second connection element 108 may be modified by the same token. On the other hand, as those skilled in the art recognized, an operating frequency band of an antenna mainly relates to a dimension of the corresponding radiating element. Therefore, the dimension of the antenna should be adjusted according to system requirements. For example, the dimension of the antenna 10 in FIG. 1 may be properly adjusted to be adapted to a millimeter-wave frequency band (such as 24 GHz), and to obtain diagrams of voltage standing wave ratio and azimuth antenna patterns as shown in FIG. 3 and FIG. 4, respectively. As can be seen in FIG. 4, the antenna gain of the antenna 10 reaches 6 dBi.

Figure 5:
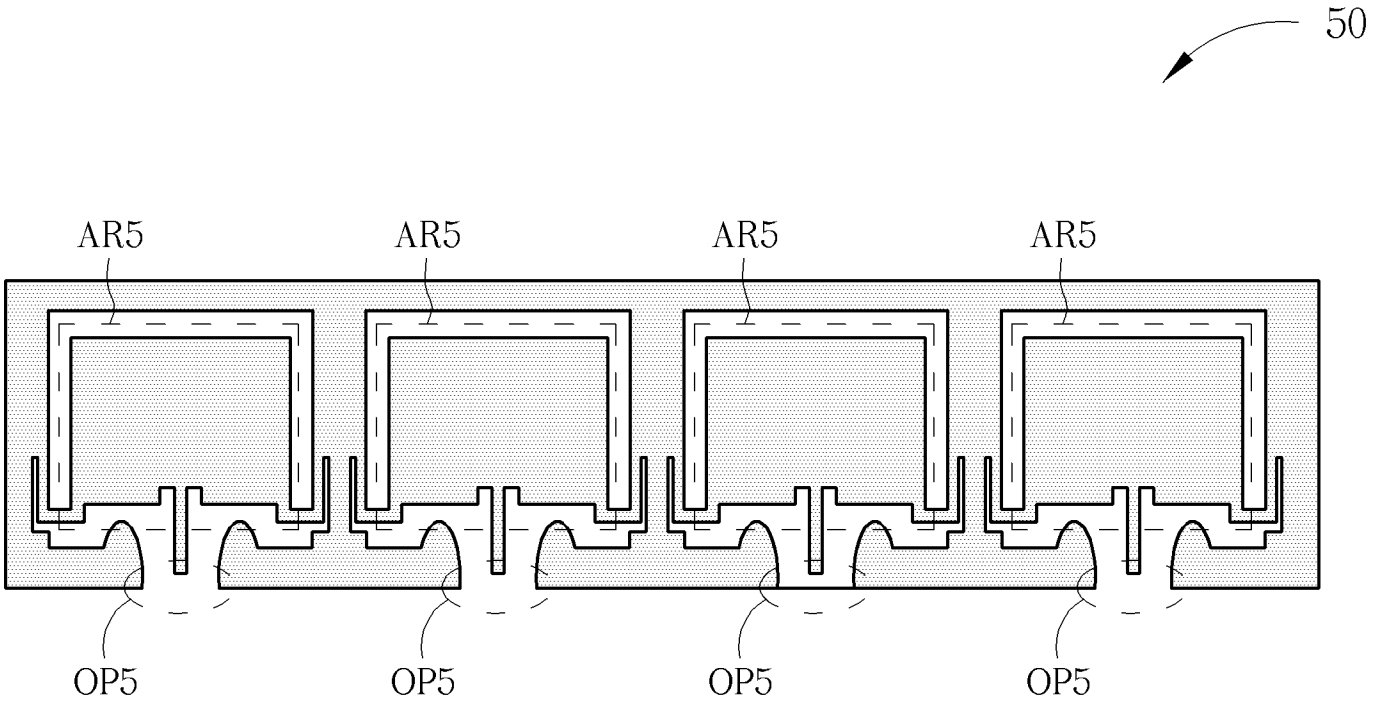
FIG. 5 is a schematic diagram of a 4×1 array antenna according to an embodiment of the present invention.

As mentioned above, the first connection element 106 and the second connection element 108 generate currents with the same direction as currents on the radiating element 100, such that currents are gathered at the center and the two sides, to increase the antenna radiation efficiency, maintain the antenna patterns, and effectively reduce the vertical length of the antenna 10. More importantly, the distances between the branches BR_11, BR_21 and the grounding and feed-in element 102 relates to the characteristics of the antenna 10. In such a condition, if the antenna 10 is further developed to an array antenna, the present invention can reduce the required area of the array antenna, and facilitate to adjust various antenna effects of the array antenna by utilizing the adjustable feature of the antenna 10. For example, FIG. 5 is a schematic diagram of a 4×1 array antenna 50 according to an embodiment of the present invention. As can be seen by comparing FIG. 1 and FIG. 5, the array antenna 50 is composed of four juxtaposed antennas 10. Similar to the antenna 10, a grounding element of the array antenna 50 forms areas AR5 for radiating elements of the array antenna 50 to be disposed therein. Also, the grounding element of the array antenna 50 also forms openings OP5 as shown in FIG. 5.

Figure 6:
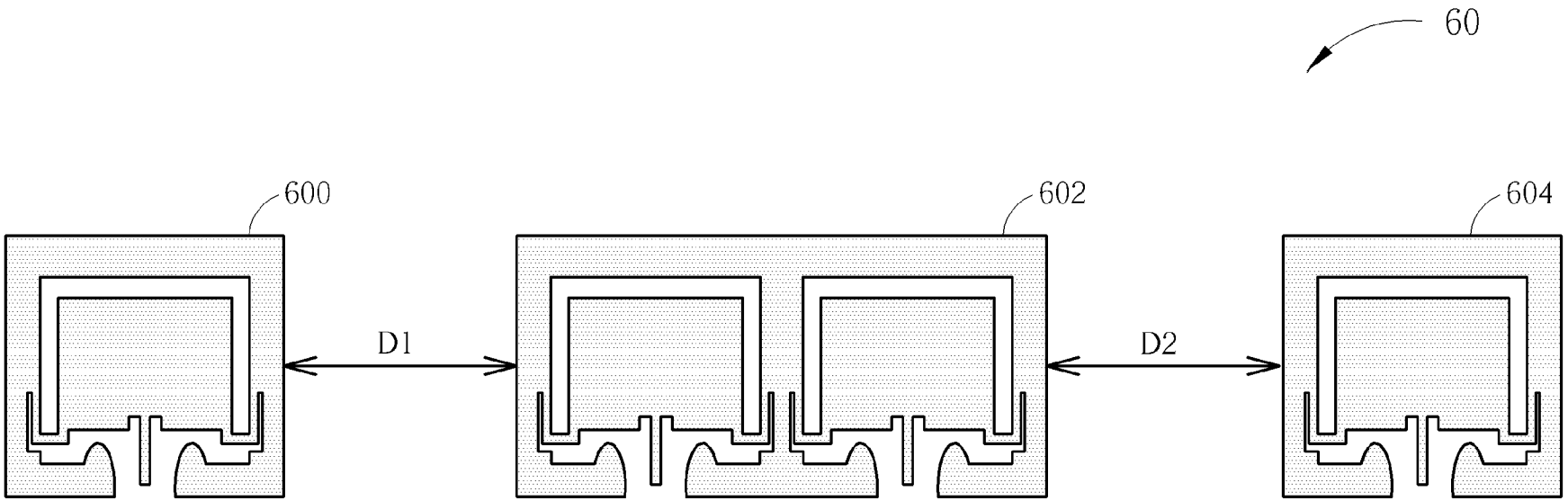
FIG. 6 is a schematic diagram of a 4×1 array antenna according to an embodiment of the present invention.

In addition, in the antenna 10, the distances between the branches BR_11, BR_21 and the grounding element 102 relate to the characteristics of the antenna 10. Accordingly, such a feature can be utilized for adjusting weightings of power distribution, by which lateral distances between sub-array antennas may be adjusted to obtain different weightings, so as to replace the conventional power divider or reduce the area needed by the power divider. For example, FIG. 6 is a schematic diagram of a 4×1 array antenna 60 according to an embodiment of the present invention. As can be seen by comparing FIG. 5 and FIG. 6, the array antenna 60 is also composed of four antennas 10, but is divided into three sub-array antennas 600, 602, 604. The sub-array antenna 602 is composed of two juxtaposed antennas 10 with distances D1, D2 to the sub-array antennas 600, 604 placed in two sides. The distances D1, D2 can be further adjusted to change the power distribution weightings for design flexibility.

Figure 7:
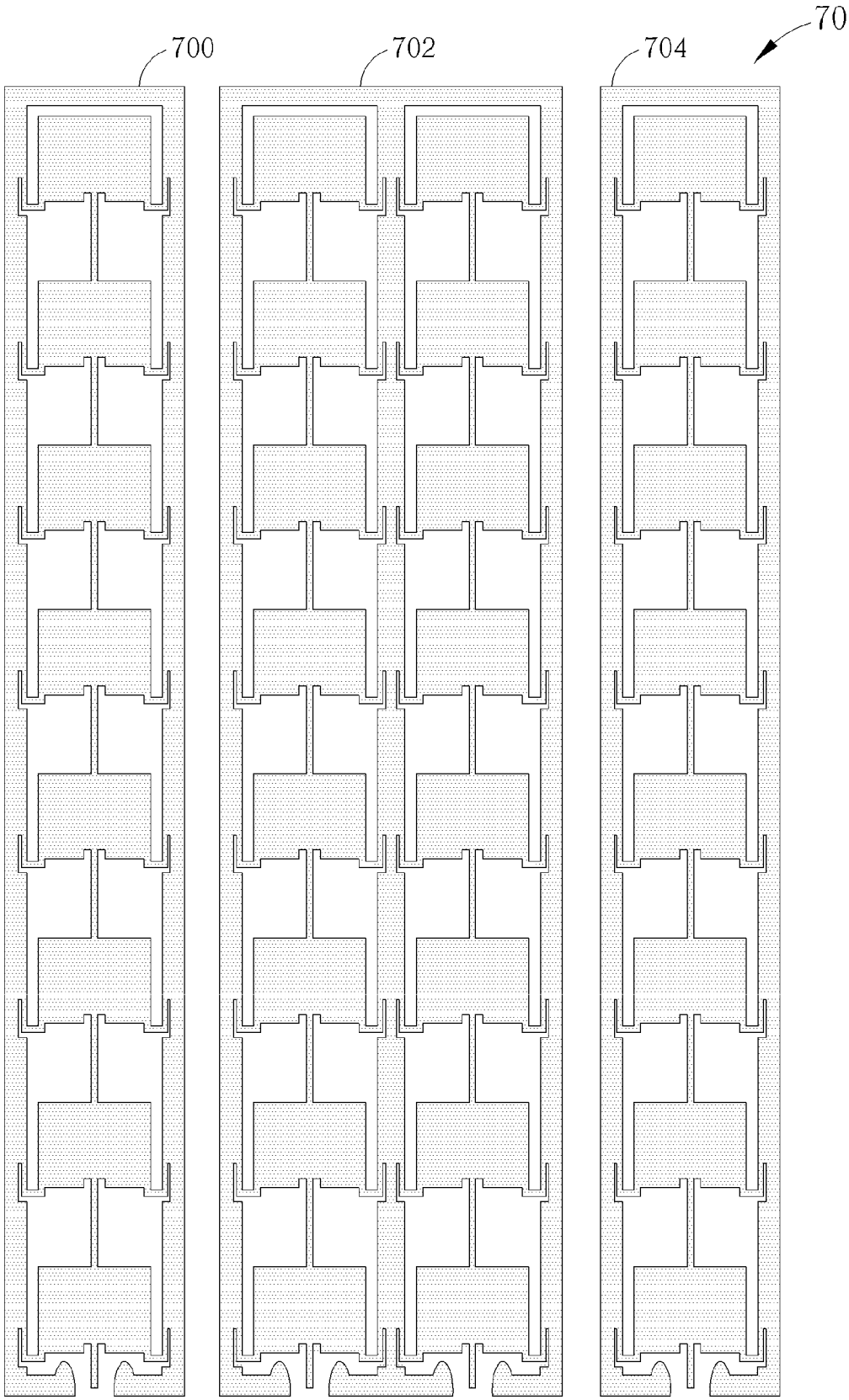
FIG. 7 is a schematic diagram of a 4×8 array antenna according to an embodiment of the present invention.

A further extension of the array antenna 60 in FIG. 6 derives a 4×n array antenna. For example, please refer to FIG. 7, which is a schematic diagram of a 4×8 array antenna 70 according to an embodiment of the present invention. The array antenna 70, derived from the array antenna 60 in FIG. 6, is also divided into three sub-array antennas 700, 702, 704, but each of the sub-array antennas 700, 702, 704 includes eight radiating elements concatenated in a series. In detail, as can be seen by comparing FIG. 1 and FIG. 7, the structure of the array antenna 70 is similar to that of the antenna 10. However, in the array antenna 70, each of the extending bars connects the second side and the fourth side of the two neighboring radiating elements, such that the eight radiating elements are concatenated in a series. And, the grounding element surrounds the concatenated radiating elements and has an opening at the bottom. Operations of the array antenna 70 can refer to the operating principles of the antenna 10 and the array antenna 60. Besides, similar to the feeding method of the antenna 10, in the array antenna 70, signals are also fed from one side of the grounding element near the opening. In other words, the array antenna 70 is a side-fed structure, which effectively reduces signal propagation loss.

Figure 8:
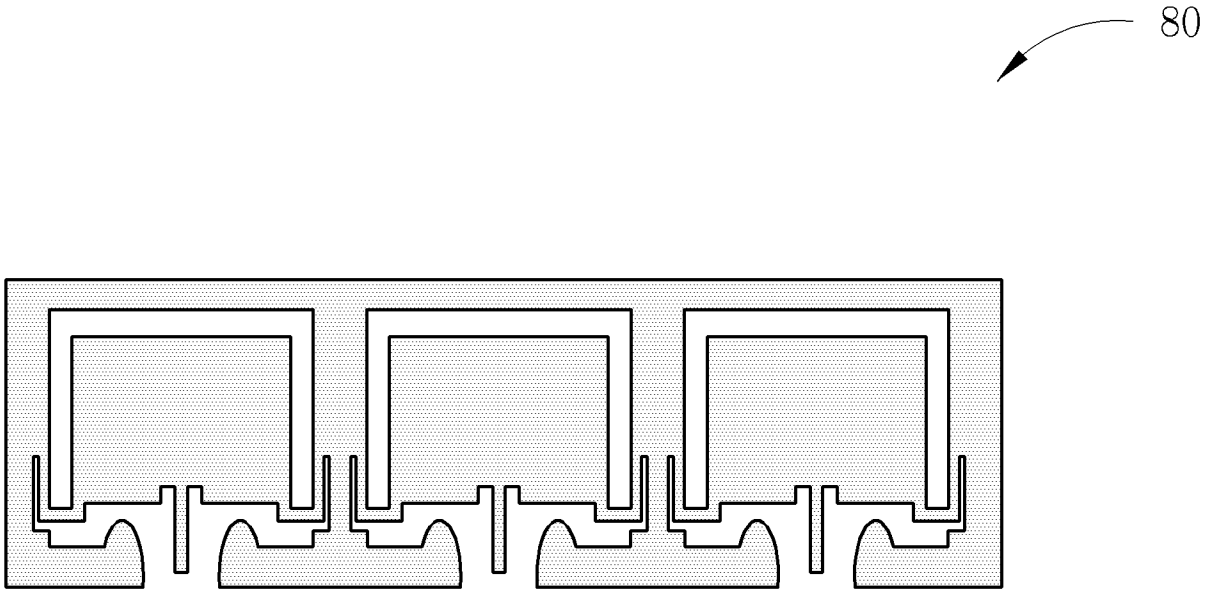
FIG. 8 is a schematic diagram of a 3×1 array antenna according to an embodiment of the present invention.
Figure 9:
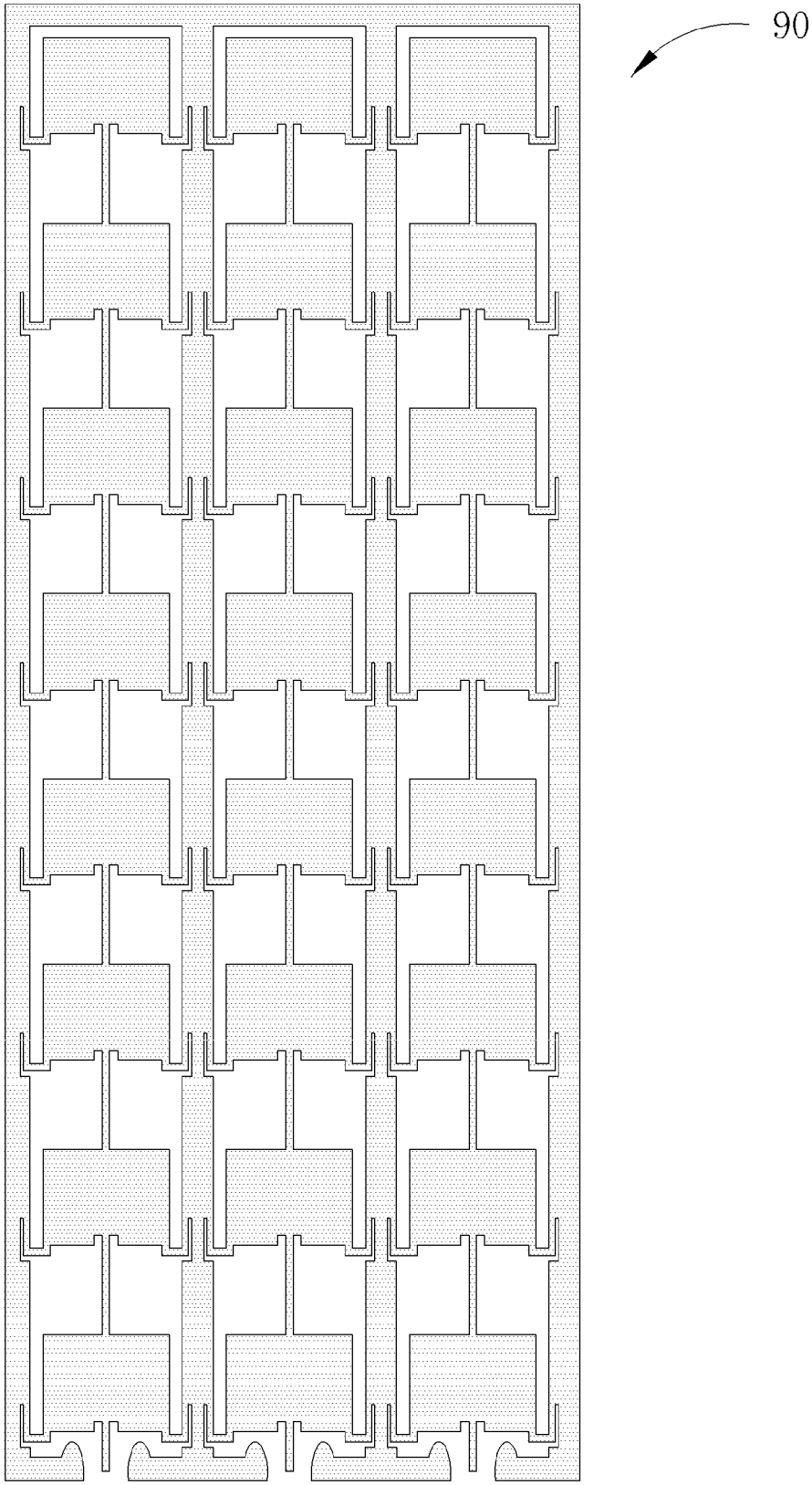
FIG. 9 is a schematic diagram of a 3×8 array antenna according to an embodiment of the present invention.

The above-mentioned 4×1, 4×8 array antennas are derivatives of the antenna 10 in FIG. 1, which illustrate a concept of adjusting the antenna characteristics by changing the distances between the connection elements and the sub-array antennas, and are not restricted thereto. For example, please refer to FIG. 8 and FIG. 9, which are schematic diagrams of a 3×1 array antenna 80 and a 3×8 array antenna 90 according to embodiments of the present invention. The structures of array antennas 80, 90 are similar to those of the above-mentioned embodiments. The main different is that each of middle sub-arrays in the array antennas 80, 90 is a common column, which connects to both the left and the right sub-arrays by a power divider, to form two receiving antennas. In such a condition, the 4×8 array antenna 70 in FIG. 7 may serve as a transmitting-end antenna, and the 3×8 array antenna 90 in FIG. 9 may serve as a receiving-end antenna, and these two antennas can be integrated into a 24 GHz or a 77 GHz monopulse radar of one transmission and two reception (1T2R). Such a monopulse radar requires a smaller antenna area, which helps to stably integrate an antenna board with other digital circuit boards, metal masks, radomes and a radar base, and is beneficial to be configured inside vehicle bumpers or grills, to satisfy volume limitations of automotive radars requested by the automotive manufactures.

Figure 10:
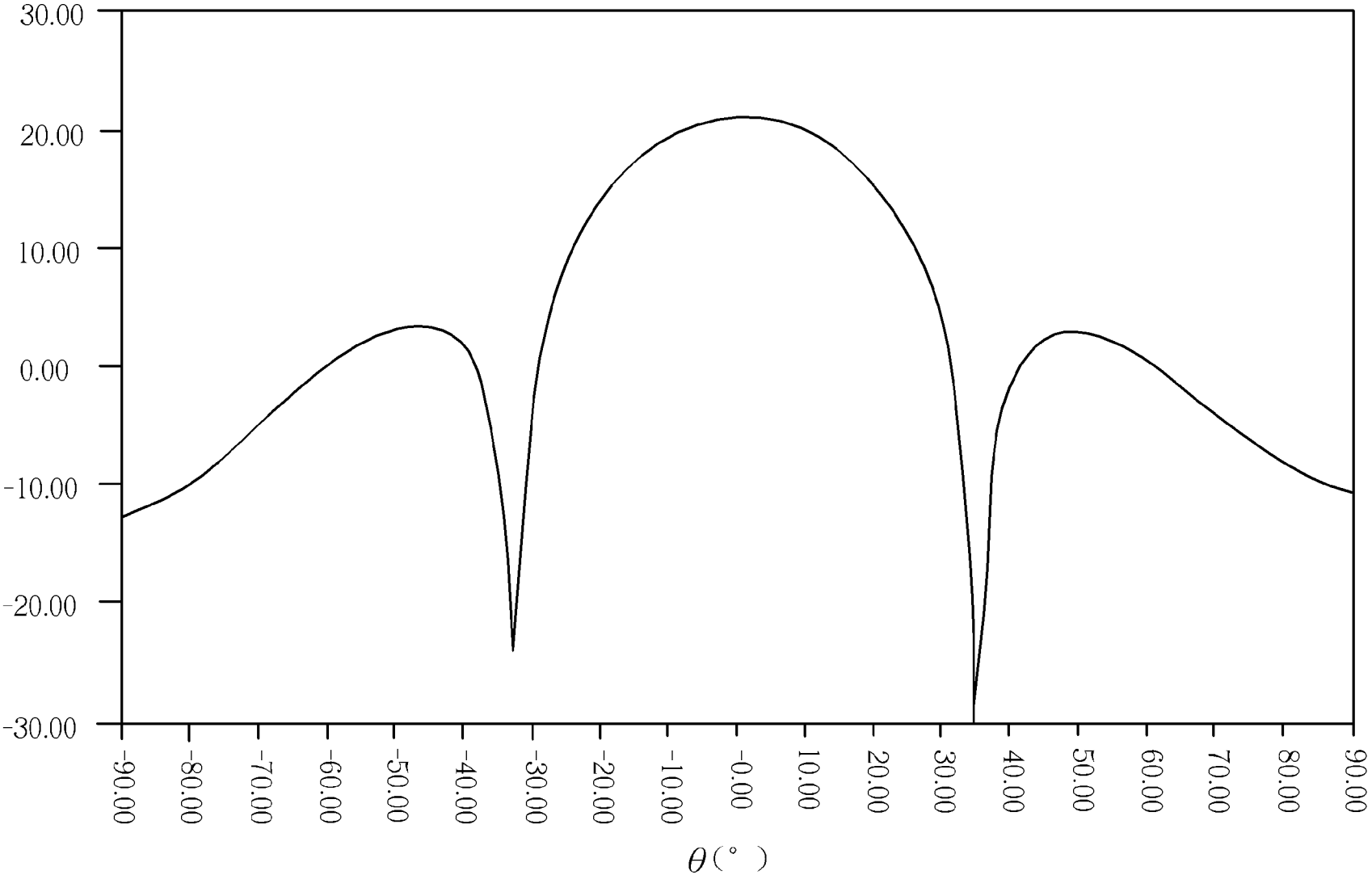
FIG. 10 is a diagram of azimuth antenna patterns of the 3×8 array antenna in FIG. 9.
Figure 11:
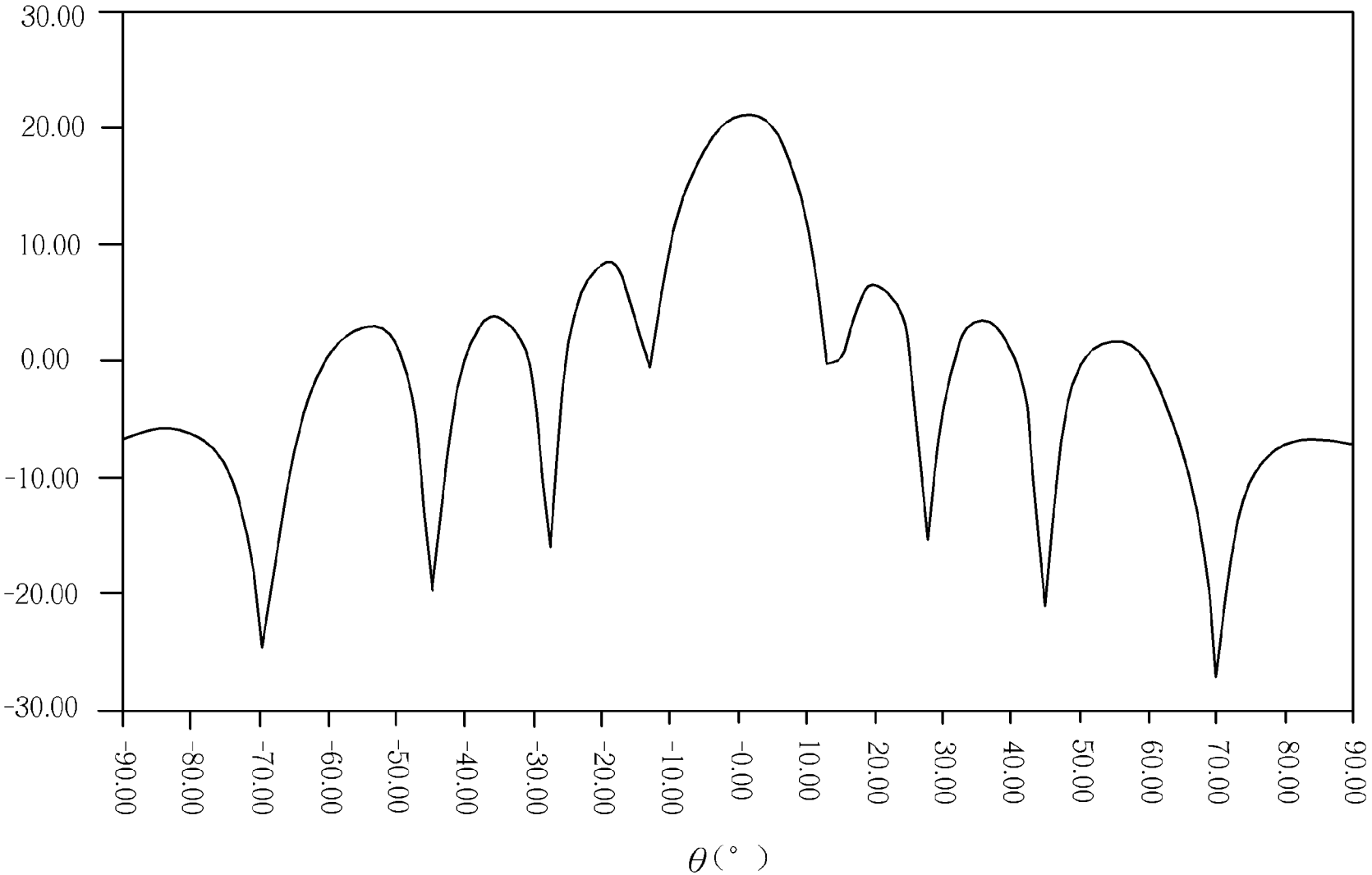
FIG. 11 is a diagram of elevation angle antenna patterns of the 3×8 array antenna in FIG. 9.

The above-mentioned array antennas 50, 60, 70, 80, 90 derived from the antenna 10 shown in FIG. 1 are embodiments of the present invention, and those skilled in the art can make modifications and alterations accordingly. For example, the dimension of the array antenna 90 in FIG. 9 may be properly adjusted to be applied to millimeter-wave frequency bands (such as 24 GHz), and to obtain diagrams of azimuth antenna patterns and elevation angle antenna patterns as shown in FIG. 10 and FIG. 11, respectively. As can be seen in FIG. 10, an antenna gain of the array antenna 90 reaches 21 dBi, and a main to side lobe ratio thereof reaches 17 dB. Similarly, FIG. 11 also demonstrates that an antenna gain of the array antenna 90 can reach 21 dBi.

To sum up, via the connection elements between the radiating element and the grounding element, the present invention effectively reduces the vertical length of the radiating element to enhance the antenna radiation efficiency and the antenna gain, or adjusts the antenna characteristics for more design flexibility, so as to derive different array antennas with good gains and reduced areas, to optimize the antenna radiation patterns.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna, comprising:

a radiating element, with a shape substantially conforming to a quadrilateral, having a first side, a second side, a third side and a fourth side, wherein the first side and the third side are substantially parallel, the second side and the fourth side are substantially parallel, and the first side is substantially perpendicular to the second side;

a grounding element, surrounding the radiating element, and having an opening formed near the fourth side of the radiating element;

an extending bar, having a terminal electrically connected to the fourth side of the radiating element, and another terminal extended toward the opening of the grounding element;

a first connection element, having a terminal electrically connected to the first side and the fourth side of the radiating element, and another terminal electrically connected to the grounding element; and a second connection element, having a terminal electrically connected to the third side and the fourth side of the radiating element, and another terminal electrically connected to the grounding element.

2. The antenna of claim 1, wherein the first connection element and the second connection element are symmetrical with regard to a centerline of the radiating element.

3. The antenna of claim 1, wherein the first connection element comprises a plurality of branches, and each branch is perpendicular to a neighboring branch.

4. The antenna of claim 1, wherein the first connection element and the grounding element form an open slot, and a width of the open slot is related to a plurality of antenna characteristics.

5. The antenna of claim 1, wherein the second connection element comprises a plurality of branches, and each branch is perpendicular to a neighboring branch.

6. The antenna of claim 1, wherein the second connection element and the grounding element form an open slot, and a width of the open slot is related to a plurality of antenna characteristics.

7. The antenna of claim 1, wherein lengths of the first connection element and the second connection element are substantially equal to a quarter-wavelength of a wireless signal transmitted or received by the antenna.

8. The antenna of claim 3, wherein a first branch of the first connection element is parallel with a current direction on the radiating element.

9. The antenna of claim 5, wherein a first branch of the second connection element is parallel with a current direction on the radiating element.

10. The antenna of claim 1, wherein the grounding element surrounds the radiating element by forming an area such that the radiating element is disposed in the area.

11. An array antenna, comprising:

a plurality of radiating elements, each with a shape substantially conforming to a quadrilateral, having a first side, a second side, a third side and a fourth side, wherein the first side and the third side are substantially parallel, the second side and the fourth side are substantially parallel, and the first side is substantially perpendicular to the second side;

a plurality of extending bars, each electrically connected to a fourth side of a radiating element and a second side of another radiating element among the plurality of radiating elements, such that the plurality of radiating elements are concatenated in a series;

a grounding element, surrounding the plurality of radiating elements, and having an opening formed near a fourth side of a radiating element among the plurality of radiating elements;

a plurality of first connection elements, each having a terminal electrically connected to a first side and a fourth side of a radiating element among the plurality of radiating elements, and another terminal electrically connected to the grounding element; and a plurality of second connection elements, each having a terminal electrically connected to a third side and a fourth side of a radiating element among the plurality of radiating elements, and another terminal electrically connected to the grounding element.

12. The array antenna of claim 11, wherein the plurality of first connection elements and the plurality of second connection elements are symmetrical with regard to a centerline of the plurality of radiating elements.

13. The array antenna of claim 11, wherein each of the plurality of first connection elements comprises a plurality of branches, and each branch is perpendicular to a neighboring branch.

14. The array antenna of claim 11, wherein each first connection element of the plurality of first connection elements and the grounding element form an open slot, and a width of the open slot is related to a plurality of antenna characteristics.

15. The array antenna of claim 11, wherein each of the plurality of second connection elements comprises a plurality of branches, and each branch is perpendicular to a neighboring branch.

16. The array antenna of claim 11, wherein each second connection element of the plurality of second connection elements and the grounding element form an open slot, and a width of the open slot is related to a plurality of antenna characteristics.

17. The array antenna of claim 11, wherein lengths of each of the plurality of first connection elements and each of the plurality of second connection elements are substantially equal to a quarter-wavelength of a wireless signal transmitted or received by the array antenna.

18. The array antenna of claim 13, wherein a first branch of each first connection element is parallel with a current direction on the radiating element.

19. The array antenna of claim 15, wherein a first branch of each second connection element is parallel with a current direction on the radiating element.

20. The array antenna of claim 11, wherein the grounding element surrounds the plurality of radiating elements by forming a plurality of areas such that the plurality of radiating elements are disposed in the plurality of areas.

* * * * *